US011421668B2

(12) United States Patent
Buscicchio et al.

(10) Patent No.: US 11,421,668 B2
(45) Date of Patent: Aug. 23, 2022

(54) FLUID POWER PACK

(71) Applicant: Dana Motion Systems Italia S.R.L., Reggio Emilia (IT)

(72) Inventors: Luca Buscicchio, Nonantola (IT); Piergiorgio Trinchieri, Reggio Emilia (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 0 days.

(21) Appl. No.: 17/180,528

(22) Filed: Feb. 19, 2021

(65) Prior Publication Data

US 2021/0262457 A1 Aug. 26, 2021

(30) Foreign Application Priority Data

Feb. 21, 2020 (EP) ..... 20158797

(51) Int. Cl.
*F04B 17/03* (2006.01)
*F04B 53/08* (2006.01)

(52) U.S. Cl.
CPC ..... *F04B 17/03* (2013.01); *F04B 53/08* (2013.01); *F05B 2260/406* (2013.01)

(58) Field of Classification Search
CPC ..... F04B 17/03; F04B 53/08; F05B 2260/406
See application file for complete search history.

(56) References Cited

U.S. PATENT DOCUMENTS 2,312,886 A * 3/1943 Ellinwood ..... F04C 2/3442 418/212
3,992,133 A * 11/1976 Brunner ..... F04D 21/00 417/372
5,145,335 A * 9/1992 Abelen ..... F04B 39/066 417/410.3
5,261,796 A 11/1993 Niemiec et al.
5,577,899 A * 11/1996 Phillips ..... F04C 15/008 418/206.1

(Continued)

FOREIGN PATENT DOCUMENTS

EP 3521627 A1 8/2019
WO 2014181437 A1 11/2014

*Primary Examiner* — Patrick Hamo
(74) *Attorney, Agent, or Firm* — McCoy Russell LLP

(57) ABSTRACT

The present disclosure relates to a fluid power pack, comprising: a manifold block comprising at least one fluid port; a first housing mounted on the manifold block and enclosing a first tank configured to hold a liquid; an electric motor mounted on the manifold block and disposed within the first tank so that the electric motor is configured to be submerged in a liquid held within the first tank for cooling the electric motor; a second housing mounted on the manifold block and enclosing a second tank configured to hold a liquid; and a hydraulic pump mounted on the manifold block and drivingly engaged with the electric motor, the hydraulic pump comprising a low pressure port and a high pressure port. The high pressure port of the hydraulic pump is in fluid communication with the fluid port of the manifold block and the low pressure port of the hydraulic pump is in fluid communication with the second tank. The present disclosure further relates to a hydraulic system including the fluid power pack and a hydraulic load fluidly connected with the fluid power pack.

17 Claims, 4 Drawing Sheets

(56) References Cited

U.S. PATENT DOCUMENTS 5,988,989 A * 11/1999 Hobson ..... F04B 17/03
417/299
7,182,583 B2 * 2/2007 Gandrud ..... H02K 9/19
417/32
8,668,467 B2 * 3/2014 Douglas ..... F04B 35/045
417/313
9,261,096 B2 * 2/2016 Lin ..... F04D 1/06

* cited by examiner

FLUID POWER PACK

CROSS-REFERENCE TO RELATED APPLICATION

The present application claims priority to European Patent Application No. 20 158 797.9, entitled "FLUID POWER PACK," and filed on Feb. 21, 2020. The entire contents of the above-listed application are hereby incorporated by reference for all purposes.

TECHNICAL FIELD

The present disclosure relates to a fluid power pack including a hydraulic pump and an electric motor for driving the hydraulic pump. The present disclosure further relates to a hydraulic system including said fluid power pack and a hydraulic load, in particular a hydraulic motor or a hydraulic cylinder, fluidly connected with the fluid power pack.

BACKGROUND AND SUMMARY

Fluid power packs including a tank for holding a liquid such as oil, a hydraulic pump in fluid communication with the tank, and an electric motor for driving the hydraulic pump are generally known. They are typically designed as ready-to-use portable devices that may be fluidly connected to a hydraulic implement such as a hydraulic motor or a hydraulic cylinder for driving the hydraulic implement.

However, in many cases known fluid power packs often do not provide sufficiently high safety standards and may at times have an unsatisfactory durability.

Thus, there is demand for a fluid power pack that provides a high level of safety and that has a long service life.

This problem is solved by a fluid power pack as described in the present disclosure and by a hydraulic system including said fluid power pack.

The presently proposed fluid power pack comprises: a manifold block comprising at least one fluid port such as a fluid outlet; a first housing mounted on the manifold block and enclosing a first tank configured to hold a liquid; an electric motor mounted on the manifold block and disposed within the first tank so that the electric motor is configured to be submerged in a liquid held within the first tank for cooling the electric motor; a second housing mounted on the manifold block and enclosing a second tank configured to hold a liquid; and a hydraulic pump mounted on the manifold block and drivingly engaged with the electric motor, the hydraulic pump comprising a low pressure port and a high pressure port, wherein the low pressure port of the hydraulic pump is in fluid communication with the second tank and the high pressure port of the hydraulic pump is in fluid communication with the fluid port of the manifold block.

The first housing enclosing the first tank may protect or additionally protect an operator against the electric motor disposed within the first tank. Further, the fact that the electric motor is disposed within the first tank and may be submerged in a liquid held within the first tank for cooling the electric motor may reduce heating of the electric motor during operation, thereby further improving operator safety and increasing the service life of the electric motor.

The fluid power pack may be configured as a portable device. For example, the fluid power pack may have an empty weight of less than 100 kg, of less than 50 kg, of less than 30 kg, or of less than 20 kg. The manifold block may be made in one piece. In particular, the manifold block may be a die-cast manifold block made of metal, for example of aluminum. However, it is understood that the manifold block may be made of or may comprise other materials such as plastic or other metals such as iron, steel or titanium. The manifold block may include a further fluid port such as a fluid inlet. The fluid inlet may then be in fluid communication with the second tank, for example.

The electric motor may be configured as or may include an AC electric motor. The electric motor typically includes a stator fixedly mounted on or connected to the manifold block, and a rotor drivingly connected with the hydraulic pump. Usually, the rotor is disposed within or at least partially within the stator so that the stator encloses or at least partially encloses the rotor. The stator usually includes electrically conducting stator windings for producing magnetic fields, and the rotor may include electrically conducting rotor windings and/or one or more permanent magnets.

The hydraulic pump may be configured as or may include a gear pump such as an external gear pump, a piston pump such as an axial piston pump or a radial piston pump, a rotary vane pump, a screw pump, or the like.

The fluid power pack may further comprise a support structure supporting the electric motor and mounted on the manifold block so that the electric motor is mounted on the manifold block via or by means of the support structure. The support structure may support at least the stator of the electric motor. However, the support structure may also support both the stator and the rotor of the electric motor. For example, the support structure may include at least one of a support frame, a plurality of support rods, support brackets, a support casing, or the like. Typically, the support structure comprises one or more rigid elements. For example, the support structure may comprise elements made of metal. However, it is understood that the support structure may be made of or may include other materials. The support structure may be mounted on or connected to the manifold block via or by means of connecting members such as screws, bolts, clamps, or the like. Similarly, the electric motor, in particular the stator, may be mounted on or connected to the support structure via or by means of connecting members such as screws, bolts, clamps, or the like.

The first housing may be detachably mounted on the manifold block. The electric motor may then be mounted on the manifold block via or by means of the support structure in such a way that the support structure holds or supports the electric motor or connects the electric motor with the manifold block both when the first housing is mounted on the manifold block and when the first housing is detached from the manifold block. Detachably mounting the first housing on the manifold block may facilitate overhauling, repairing or cleaning the electric motor, the first housing and/or the manifold block. Also, it is conceivable that first housings of different sizes may be detachably mounted on the manifold block, for example depending on a size of the electric motor.

The fluid power pack may further comprise a first bearing rotationally supporting a motor shaft drivingly connected with the rotor of the electric motor. The first bearing may be mounted on the support structure. The fluid power pack may also comprise a second bearing rotationally supporting the motor shaft. The second bearing may be mounted on the manifold block. The motor shaft or a drive member drivingly connecting the rotor of the electric motor with the hydraulic pump may reach through the manifold block. For example, the electric motor and the hydraulic pump may be mounted on the manifold block on mutually opposite sides of the manifold block. For instance, this may facilitate exchanging, overhauling, repairing or cleaning the electric motor and/or the hydraulic pump.

The fluid power pack may further comprise a relief valve. The relief valve may be mounted on or integrated in the manifold block. The relief valve may be configured to fluidly connect the high pressure port of the hydraulic pump with the second tank when a pressure at the high pressure port of the hydraulic pump exceeds a threshold pressure. This way, a hydraulic implement such as a hydraulic motor or a hydraulic cylinder fluidly connected to the high pressure port of the hydraulic pump may be protected from excessively high pressures at the high pressure port of the hydraulic pump.

The fluid power pack may further comprise a check valve. The check valve may be mounted on or integrated in the manifold block. The check valve may be configured to allow a liquid flow from the high pressure port of the hydraulic pump toward the fluid outlet of the manifold block via the check valve, and the check valve may be configured to block a liquid flow toward the high pressure port of the hydraulic pump via the check valve, in particular from the fluid outlet of the manifold block. The check valve may further be configured to block a liquid flow from the fluid inlet of the manifold block toward the high pressure port of the hydraulic pump through the check valve. The check valve may protect the hydraulic pump and/or may guarantee a proper functioning of the hydraulic pump.

A liquid storage capacity V1 of the first tank and a liquid storage capacity V2 of the second tank may fulfill one or more of the following relations: $V2 \geq V1$, $V2 \geq 2 \cdot V1$, $V2 \geq 5 \cdot V1$, and $V2 \geq 10 \cdot V1$. For example, V2 may have a liquid storage capacity of at least 5 liters, of at least 10 liters, of at least 20 liters, of at least 50 liters, or of at least 100 liters.

The hydraulic pump may be disposed within the second tank. Also, the first tank may be in fluid communication with the second tank, such as via the manifold block. For example, the manifold block may comprise one or more fluid passages fluidly connecting the first tank with the second tank. These fluid passages may be integrated in the manifold block. Fluid communication between the first tank and the second tank allows the exchange of liquid between the first tank and the second tank. In this way, heated motor cooling liquid held within the first tank may be exchanged for cooler liquid held within the second tank, thereby increasing the cooling capacity of the fluid power pack.

Further, a hydraulic system is presently proposed, the hydraulic system comprising: the previously described fluid power pack, and a hydraulic load, in particular a hydraulic motor or a hydraulic cylinder, wherein the hydraulic load is fluidly connected with the fluid power pack via the fluid inlet and the fluid outlet of the manifold block.

BRIEF DESCRIPTION OF THE FIGURES

An embodiment of the presently proposed fluid power pack and hydraulic system is described in the following detailed description and is depicted in the accompanying drawing in which.

DETAILED DESCRIPTION

Figure 1:
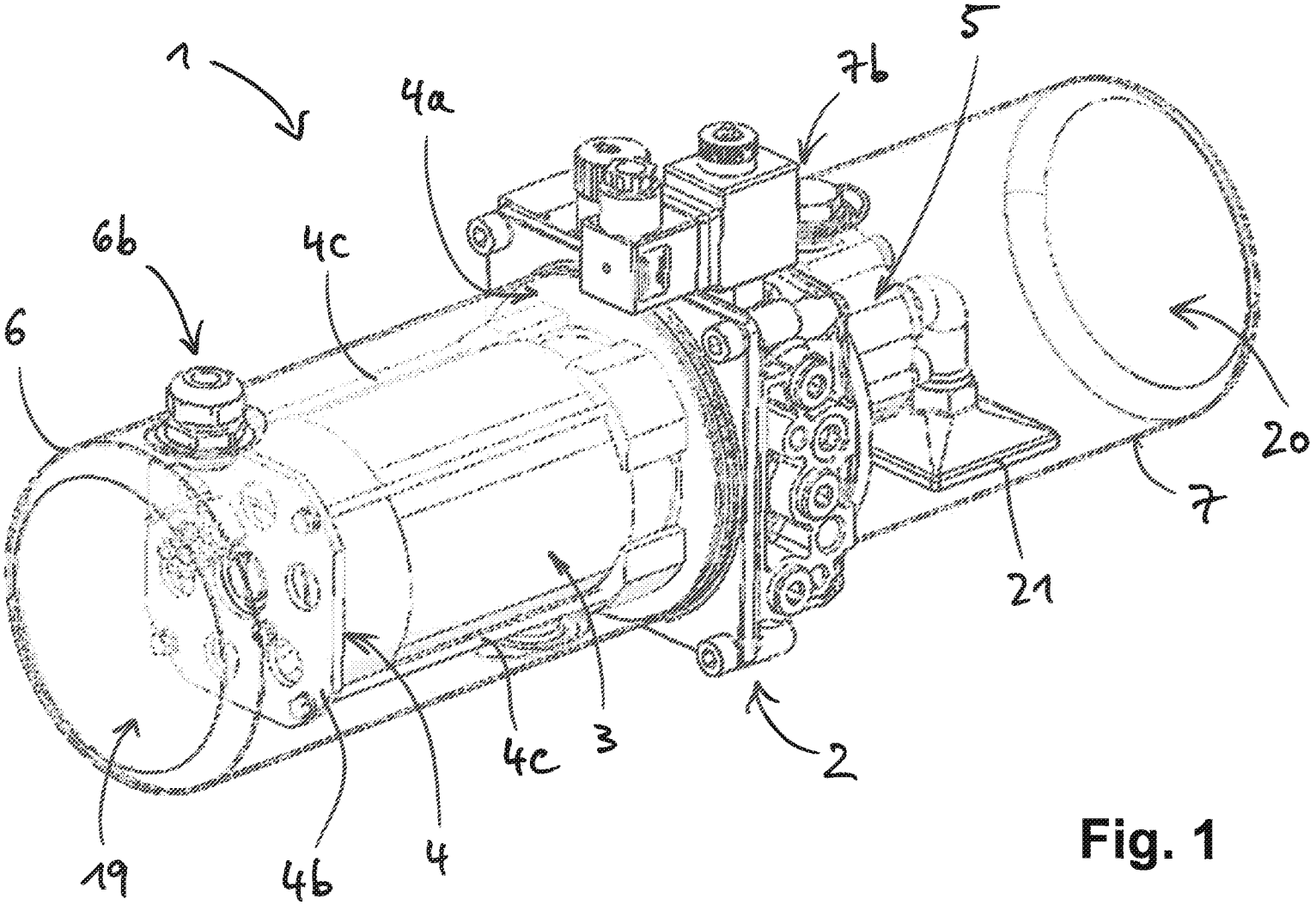
FIG. 1 shows a perspective view of an embodiment of a fluid power pack.
Figure 2:
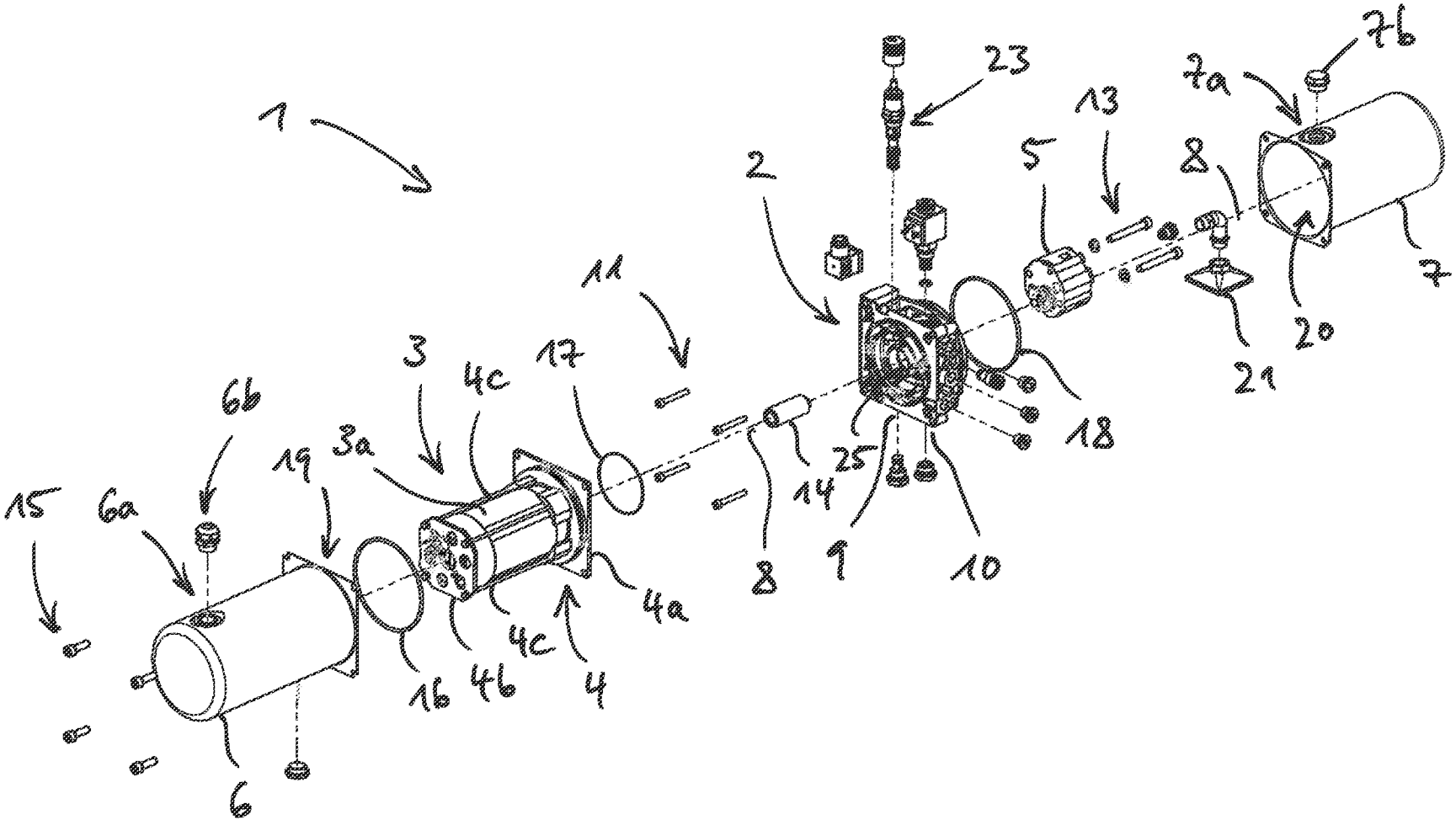
FIG. 2 shows an exploded view of the fluid power pack of FIG. 1.
Figure 3:
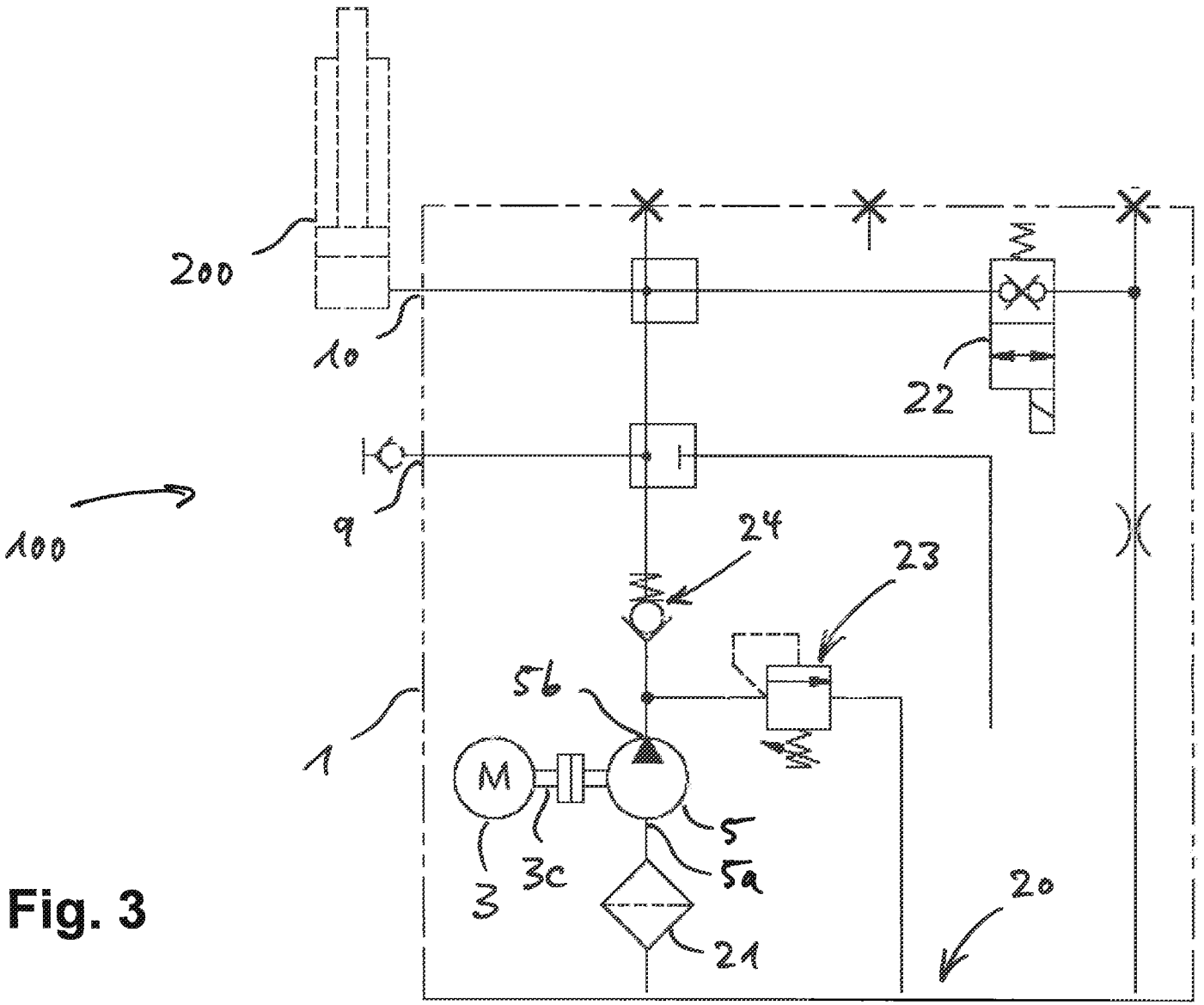
FIG. 3 shows a schematic of a hydraulic system including the fluid power pack of FIGS. 1 and 2.
Figure 4:
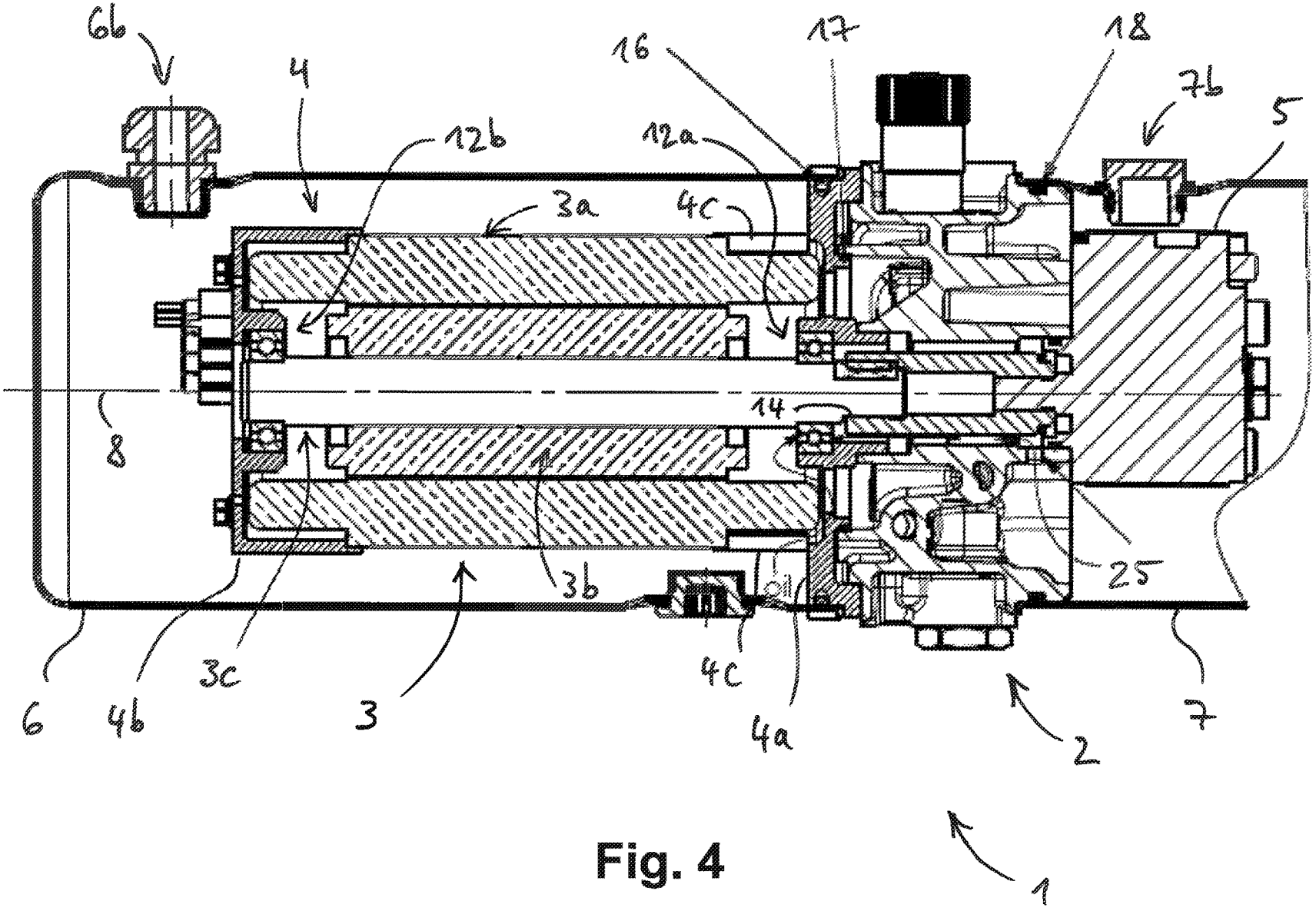
FIG. 4 shows a sectional view of a detail of the fluid power pack of FIGS. 1-3.

FIGS. 1 and 2 each depict an embodiment of a fluid power pack 1. FIG. 1 shows the fluid power pack 1 in an assembled state, and FIG. 2 shows the fluid power pack 1 in an exploded view. FIG. 3 illustrates a schematic of a hydraulic system 100 including the fluid power pack 1 of FIGS. 1 and 2, and further including a hydraulic cylinder 200 fluidly connected with the fluid power pack 1. FIG. 4 shows a sectional view of the fluid power pack 1. Features recurring in different figures are designated with the same reference signs throughout.

The fluid power pack 1 comprises a die-cast aluminum manifold block 2, an electric motor 3, a support structure 4 for mounting the electric motor 3 on or for connecting the electric motor 3 to the manifold block 2, a hydraulic pump 5 drivingly engaged with the electric motor 3 so that the electric motor 3 may drive the hydraulic pump 5, a first housing 6 and a second housing 7. The electric motor 3 is configured as an AC motor. As can best be seen in FIG. 4, the electric motor 3 includes a stator 3*a* having a plurality of stator windings, a rotor 3*b* comprising a plurality of rotor windings, and a motor shaft 3*c* connected to the rotor 3*b*. The rotor 3*b* may rotate relative to the stator 3*a* with respect to a rotation axis 8 defining an axial direction. It is understood that in alternative embodiments the rotor may comprise one or more permanent magnets or a conducting squirrel cage, for example. The manifold block 2 includes a plurality of fluid ports such as a fluid inlet 9 and a fluid outlet 10 (see FIG. 2) for connecting the fluid power pack 1 to a hydraulic load such as the hydraulic cylinder 200 depicted in FIG. 3, and a plurality of fluid passages integrated in the manifold block 2.

In the embodiment of the fluid power pack 1 depicted in the figures, the support structure 4 includes a flange portion 4*a* connected to the manifold block 2, an end portion 4*b* and a plurality of rods 4*c* connecting the end portion 4*b* with the flange portion 4*a*, as illustrated in FIGS. 1 and 2, for example. For instance, the flange portion 4*a* may be connected or fixed to the manifold block 2 by means of a plurality of first connecting members 11, as shown in FIG. 2. The plurality of first connecting members may include a plurality of screws, for example. The manifold block 2 may then include threaded bores for accommodating the first connecting members 11 in the manifold block 2. However, it is understood that in alternative embodiments the first connecting members 11 may include connecting members other than screws. Here, the flange portion 4*a*, the end portion 4*b* and the rods 4*c* are made of metal. However, it is understood that the support structure 4 may be made of or may comprise other materials. The electric motor 3 is received in the support structure 4. The support structure 4 fixes the electric motor 3 relative to the manifold block 2 and connects the electric motor 3 to the manifold block 2. In particular, the stator 3*a* is clamped or fixed in between the flange portion 4*a* and the end portion 4*b* of the support structure 4 along the axial direction of rotation axis 8. The motor shaft 3*c* is mounted on a bearing 12*a* and a bearing 12*b*. The bearings 12*a*, 12*b* rotationally support the motor shaft 3*c*. The bearings 12*a*, 12*b* may be configured as roller bearings, for example. The bearing 12*a* is mounted on or fixed to the flange portion 4*a* of the support structure 4 or the manifold block 2. The bearing 12*b* is mounted on or fixed to the end portion 4*b* of the support structure 4.

In the embodiment of the fluid power pack 1 depicted in the figures the hydraulic pump 5 is configured as or comprises a gear pump, for example an external gear pump. However, it is understood that in alternative embodiments the hydraulic pump 5 may be configured as or may comprise a piston pump such as an axial piston pump or a radial piston pump, a rotary vane pump, a screw pump, or another type of hydraulic pump known in the art. As can best be seen in FIG. 2, the electric motor 3 and the hydraulic pump 5 are mounted on the manifold block 2 on axially opposing sides of the manifold block 2. Here, the hydraulic pump 5 is mounted on or fixed to the manifold block 2 by means of a plurality of second connecting members 13. The plurality of second connecting members may include a plurality of screws, for example. The manifold block 2 may then include threaded bores for accommodating the second connecting members 13 in the manifold block 2. However, it is understood that in alternative embodiments the second connecting members 13 may include connecting members other than screws. The hydraulic pump 5 is drivingly engaged with the rotor 3*b* of the electric motor 3 through a drive member 14 which is drivingly connected with the motor shaft 3*c*. As can be seen in FIG. 4, the drive member 14 reaches through the manifold block 2 along the axial direction of rotation axis 8. It is understood that in alternative embodiments the hydraulic pump 5 may be directly connected with the motor shaft 3*c*.

The first housing 6 is detachably mounted on or fixed to the manifold block 2 by means of a plurality of third connecting members 15. The plurality of third connecting members 15 may include a plurality of screws, for example. The manifold block 2 may then include threaded bores for accommodating the third connecting members 15 in the manifold block 2. However, it is understood that in alternative embodiments the third connecting members 15 may include connecting members other than screws. The support structure 4 is designed such that it fixes the electric motor 3 to the manifold block 2 both when the first housing 6 is mounted on the manifold block 2 and when the first housing 6 is detached from the manifold block 2.

The first housing 6 encloses a first tank 19 which is configured to hold a liquid such as oil. For example, the first housing 6 may have the form of a cylinder which is open on one side, in particular on a side of the first housing 6 facing the manifold block 2. When the first housing 6 is mounted on or fixed to the manifold block 2, the first tank 19 is open toward the manifold block 2 and the electric motor 3 projects into the first tank 19 so that the electric motor 3 is disposed or received within the first tank 19. A first sealing member 16 may be disposed between the first housing 6 and the manifold block 2 or between the first housing 6 and the flange portion 4*a* of the support structure 4 for sealing the first tank 19 when the first housing 6 is mounted on the manifold block 2 and the electric motor is disposed or received within the first tank 19 enclosed by the first housing 6. A second sealing member 17 may be disposed in between the flange portion 4*a* of the support structure 4 and the manifold block 2.

When the first housing 6 is mounted on or fixed to the manifold block 2 and the first tank 19 is filled or at least partially filled with a liquid such as oil, the electric motor 3 disposed or received within the first tank 19 is submerged or at least partially submerged in the liquid held within the first tank 19. In this way, a liquid held within the first tank 19 may cool the electric motor 3 when the electric motor 3 is running. For instance, the first housing 6 may include an opening 6*a* for filling or draining the first tank 19 enclosed by the first housing 6 via the opening 6*a*. The first housing 6 may then further include a fastener 6*b* for opening and closing the opening 6*a*.

For example, the electric motor 3 and the first tank 19 enclosed by the first housing 6 may be configured such that when the first housing 6 is mounted on or fixed to the manifold block 2, a liquid held within the first tank 19 may contact the stator 3*a* on an outer surface of the stator 3*a* extending along the axial direction, optionally on all sides. Also, the electric motor 3 may be configured such that a liquid held within the first tank 19 may enter a gap in between the stator 3*a* and the rotor 3*b* of the electric motor 3 so that the liquid held within the first tank 19 may cool both the stator 3*a* and the rotor 3*b*.

The second housing 7 is mounted on or fixed to the manifold block 2, for example by means of a plurality of fourth connecting members such as screws (not shown). The second housing 7 encloses a second tank 20 which is configured to hold a liquid such as oil. For example, the second housing 7 may have the form of a cylinder which is open on one side, in particular on a side of the second housing 7 facing the manifold block 2. When the second housing 7 is mounted on or fixed to the manifold block 2, the second tank 20 is open toward the manifold block 2 and the hydraulic pump 5 projects into the second tank 20 so that the hydraulic pump 5 is disposed or received within the second tank 20. A fourth sealing member 18 may be disposed between the second housing 7 and the manifold block 2 for sealing the second tank 20. The second housing 7 may include an opening 7*a* for filling or draining the second tank 20 enclosed by the second housing 7 via the opening 7*a*. The second housing 7 may then further include a fastener 7*b* for opening and closing the opening 7*a*. A liquid storage capacity V2 of the second tank 20 may be larger than a liquid storage capacity V1 of the first tank 19. For example, the liquid storage capacity V2 of the second tank 20 may be at least two times, at least five times or at least ten times the storage capacity V1 of the first tank 19.

When the second housing 7 is mounted on or fixed to the manifold block 2 so that the hydraulic pump 5 is disposed within or projects into the second tank 20, a low pressure port 5*a* of the hydraulic pump 5 is in fluid communication with the second tank 20, for example via a filter 21 configured to filter a liquid entering the low pressure port 5*a*, see FIG. 3, for example. Further, a high pressure port 5*b* of the hydraulic pump 5 is in fluid communication with the fluid outlet 10 of the manifold block 2 so that the hydraulic pump 5 driven by the electric motor 3 may pump liquid from the second tank 20 toward the fluid outlet 10 of the manifold block 2. From the fluid outlet 10 the high pressure liquid may be delivered to a hydraulic load such as the hydraulic cylinder 200 for pressurizing the hydraulic load. A low pressure port of the hydraulic load may be fluidly connected with the fluid inlet 9 of the manifold block, for example (not shown). As can be seen in FIG. 3, both the fluid inlet 9 and the fluid outlet 10 of the manifold block 2 may be in fluid communication with the second tank 20, here via a solenoid valve 22.

The fluid power pack 1 may further include a relief valve 23, as shown in FIG. 3, for example. The pressure relief valve 23 may be mounted on or integrated in the manifold block 2. In the schematic depicted in FIG. 3, the relief valve 23 may fluidly connect the high pressure port 5*b* of the hydraulic pump 5 with the second tank 20 when a pressure at the high pressure port 5*b* of the hydraulic pump exceeds a threshold pressure. In this manner, the relief valve 23 may protect a hydraulic load such as the hydraulic cylinder 200 from an excess pressure at the high pressure port 5*b* of the hydraulic pump 5.

The fluid power pack 1 may also include a check valve 24, as illustrated in FIG. 3, for example. The check valve 24 may be mounted on or integrated in the manifold block 2. The check valve 24 depicted in FIG. 3 is configured to allow a liquid flow from the high pressure port 5*b* of the hydraulic pump 5 toward the fluid outlet 10 of the manifold block 2 via the check valve 24, and to block a liquid flow toward the high pressure port 5*b* of the hydraulic pump 5 via the check valve 24. The check valve 24 may further be configured to block a liquid flow from the fluid inlet 9 of the manifold block 2 toward the high pressure port 5*b* of the hydraulic pump 5 through the check valve 24.

Advantageously, the manifold block 2 may include at least one fluid passage 25 providing fluid communication between the first tank 19 and the second tank 20 when both the first housing 6 and the second housing 7 are mounted on or fixed to the manifold block 2. For example, the fluid passage 25 may be formed in between the manifold block 2 and the drive member 14 reaching through a through opening in the manifold block 2 and drivingly connecting the rotor 3*b* of the electric motor 3 with the hydraulic pump 5. However, it is understood that the manifold block 2 may include other or additional fluid passages providing fluid communication between the two tanks 19, 20. By means of a fluid passage between the tanks 19, 20 such as the fluid passage 25 liquid held within the first tank 19 may be exchanged for liquid held within the second tank 20. As the liquid held within the first tank 19 typically heats up during operation of the electric motor 3, the fluid passage 25 providing fluid communication between the tanks 19, 20 may increase the cooling capacity of the fluid power pack 1 as heat from the electric motor 3 may additionally be given off to the liquid held within the second tank 20 and/or to the liquid circulated between the hydraulic pump 5 and a hydraulic load connected to the fluid power pack 1 such as the hydraulic cylinder 200 depicted in FIG. 3.

The invention claimed is:

1. A fluid power pack, comprising:

a manifold block comprising one or more fluid ports;

a first housing mounted on the manifold block and enclosing a first tank configured to hold a liquid;

an electric motor mounted on the manifold block and disposed within the first tank so that the electric motor is configured to be submerged in a liquid held within the first tank for cooling the electric motor;

a second housing mounted on the manifold block and enclosing a second tank configured to hold a liquid; and a hydraulic pump mounted on the manifold block and drivingly engaged with the electric motor, the hydraulic pump comprising a low pressure port and a high pressure port, wherein the high pressure port of the hydraulic pump is in fluid communication with a fluid port of the manifold block and the low pressure port of the hydraulic pump is in fluid communication with the second tank.

2. The fluid power pack of claim 1, further comprising a support structure supporting the electric motor and mounted on the manifold block so that the electric motor is mounted on the manifold block via the support structure.

3. The fluid power pack of claim 2, wherein the first housing is detachably mounted on the manifold block and wherein the electric motor is mounted on the manifold block via the support structure in such a way that the support structure supports the electric motor both when the first housing is mounted on the manifold block and when the first housing is detached from the manifold block.

4. The fluid power pack of claim 3, further comprising at least one first bearing mounted on the support structure and rotationally supporting a motor shaft drivingly connected with a rotor of the electric motor.

5. The fluid power pack of claim 4, further comprising a second bearing mounted on the manifold block and rotationally supporting the motor shaft.

6. The fluid power pack of claim 1, further comprising one of a relief valve mounted on the manifold block and a relief valve integrated in the manifold block, the relief valve being configured to fluidly connect the high pressure port of the hydraulic pump with the second tank when a pressure at the high pressure port of the hydraulic pump exceeds a threshold pressure.

7. The fluid power pack of claim 1, further comprising one of a check valve mounted on the manifold block and a check valve integrated in the manifold block, the check valve being configured to allow a liquid flow from the high pressure port of the hydraulic pump toward a fluid outlet of the manifold block via the check valve, and the check valve configured to block a liquid flow toward the high pressure port of the hydraulic pump via the check valve.

8. The fluid power pack of claim 7, wherein the check valve is further configured to block a liquid flow from a fluid inlet of the manifold block toward the high pressure port of the hydraulic pump through the check valve.

9. The fluid power pack of claim 1, wherein a liquid storage capacity V1 of the first tank and a liquid storage capacity V2 of the second tank fulfill one or more of the following relations: $V2V2 \geq V1$, $V2 \geq 2 \cdot V1$, $V2 \geq 5 \cdot V1$, and $V2 \geq 10 \cdot V1$.

10. The fluid power pack of claim 1, wherein the hydraulic pump is disposed within the second tank.

11. The fluid power pack of claim 1, wherein the first tank is in fluid communication with the second tank.

12. The fluid power pack of claim 11, wherein the first tank is in fluid communication with the second tank via the manifold block.

13. The fluid power pack of claim 1, wherein a motor shaft drivingly connecting a rotor of the electric motor with the hydraulic pump reaches through the manifold block.

14. The fluid power pack of claim 1, wherein the manifold block is a die-cast manifold block made of metal.

15. The fluid power pack of claim 14, wherein the manifold block is made of aluminum.

16. A hydraulic system, comprising:

a fluid power pack, comprising:

a manifold block comprising one or more fluid ports;

a first housing mounted on the manifold block and enclosing a first tank configured to hold a liquid;

an electric motor mounted on the manifold block and disposed within the first tank so that the electric motor is configured to be submerged in a liquid held within the first tank for cooling the electric motor;

a second housing mounted on the manifold block and enclosing a second tank configured to hold a liquid; and a hydraulic pump mounted on the manifold block and drivingly engaged with the electric motor, the hydraulic pump comprising a low pressure port and a high pressure port, wherein the high pressure port of the hydraulic pump is in fluid communication with a fluid port of the manifold block and the low pressure port of the hydraulic pump is in fluid communication with the second tank; and a hydraulic load fluidly connected with the fluid power pack via the fluid port of the manifold block.

17. The hydraulic system of claim 16, wherein the hydraulic load includes one of: a hydraulic motor, and a hydraulic cylinder.

* * * * *